US005681182A

United States Patent [19]

Reichle

[11] Patent Number: 5,681,182

[45] Date of Patent: Oct. 28, 1997

[54] MODULAR CONTACT MOUNT FOR SOLDERLESS INSULATION DISPLACEMENT WIRE CONNECTION OF ELECTRICAL WIRES

[75] Inventor: Hans Reichle, Wetzikon, Switzerland

[73] Assignee: Reichle + De-Massari AG, Wetzikon, Switzerland

[21] Appl. No.: 678,300

[22] Filed: Jul. 11, 1996

[30] Foreign Application Priority Data

Jul. 13, 1995 [CH] Switzerland ..... 02 059/95

[51] Int. Cl.[6] ..... H01R 4/24

[52] U.S. Cl. ..... 439/417; 439/174; 439/409

[58] Field of Search ..... 439/417, 409, 439/188, 174

[56] References Cited

U.S. PATENT DOCUMENTS

| | | | |
|---|---|---|---|
| 5,338,220 | 8/1994 | Soes et al. | 439/417 |
| 5,435,747 | 7/1995 | Franckx et al. | 439/409 |
| 5,498,172 | 3/1996 | Noda | 439/417 |
| 5,562,478 | 10/1996 | Yamamoto | 439/417 |

FOREIGN PATENT DOCUMENTS

| | | |
|---|---|---|
| 0310832 | 4/1989 | European Pat. Off. . |
| 0639870 | 2/1995 | European Pat. Off. . |

*Primary Examiner*—Neil Abrams
*Assistant Examiner*—T. C. Patel
*Attorney, Agent, or Firm*—Spencer & Frank

[57] ABSTRACT

An assembly for forming a solderless insulation displacement wiring connection of electrical wires, includes a modular contact mount. At least two insulation displacement contacts are located within the contact mount. Each displacement contact has an insulation displacer region formed on an end thereof. An arrangement is provided for gripping both an incoming wire and an extending wire inserted into the assembly. The arrangement is movable to press a selected wire into the respective insulation displacer region when the assembly means is pressed downward toward the contact mount, to form a disconnectable through-connection of the incoming and outgoing wires.

6 Claims, 3 Drawing Sheets

FIG. 7

MODULAR CONTACT MOUNT FOR SOLDERLESS INSULATION DISPLACEMENT WIRE CONNECTION OF ELECTRICAL WIRES

BACKGROUND OF THE INVENTION

The present invention relates to a modular contact mount for a solderless insulation displacement wire connection of insulated electrical wires, having means which press an inserted wire into an insulation displacer of an insulation displacement contact when pressed down onto the contact mount.

A similar arrangement is known from the EP Patent No. 310832, wherein a multiple contact pin holder of a modular plug-type connector for telecommunications equipment is shown. The means for the insulation displacement wire connection (wiring) comprises a swiveling cover which can be pressed down onto the body of the contact pin holder for the purpose of pressing the inserted wire into the insulation displacer of the contact pins.

In EP Patent No. 639870, on the other hand, the means for pressing the inserted wires into the insulation displacer when pressed downward against the contact mount comprises a key.

In all these known arrangements, relatively thin wires with thin insulation are attached to a multiple plug strip, and this plug strip is then attached to other connection means to which wires are attached in a plug-type connection.

Creating a disconnectable through-connection of incoming and extending wires without using plugs is, on the other hand, not possible with the known arrangements.

SUMMARY OF THE INVENTION

The purpose of the present invention is to provide a modular contact mount which permits disconnectable through-connections of incoming wires and extending (outgoing) wires, such as overhead lines and internal wires, by means of a solderless, insulation displacement wire connection, without using the expensive and difficult-to-use plug strips.

This purpose is fulfilled according to the invention in that the modular contact mount is adapted to create a disconnectable through-connection of incoming and outgoing wires, whereby means grip each incoming and extending wire and, when pressed downward, press the incoming or extending wire into the insulation displacer of the respective insulation displacement contact.

Preferably, the means for pressing the incoming wire, which is normally thick and covered with hard insulation, downward into the insulation displacer of the respective insulation displacement contact comprises a swiveling cover which is attached to the contact mount in a hinged connection. The means for pressing the extending wire, which is normally thin and covered with thin insulation, into the insulation displacer of the respective insulation displacement contact comprises a key.

Preferably, the swiveling cover and the key can be released for the purpose of rearranging a connection, whereby the key can be shifted from its depressed connected position to an intermediate position at which the through-connection is disconnected and whereby the insulation displacement contact for the extending wire, which functions together with the key, can be shifted by means of the key to a position between a connected position and a disconnected position. For this purpose, the insulation displacement contact for the extending wire can be shifted within a slotted guide on the contact mount and actuated by the key via a carrier. Further, the insulation displacement contact is provided with a forked contact on its free end.

For a simple, practical, trouble-free and temporary disconnection of the through-connection without breaking the insulation displacement connection, the insulation displacement contact for the incoming wire is preferably supported by the contact mount and provided with an L-shaped downward projection having a contact head on its free end. The contact head extends into a shifting path of the insulation displacement contact for the extending wire, which is shaped as a forked contact.

Fixing thick wires having hard insulation in an insulation displacement wire connection at the insulation displacement contact is possible when the area near the insulation displacer of such an insulation displacement contact, especially for the incoming wire, is bent away from (i.e., counter to) the swiveling movement of the swiveling cover and is provided with knife-like angled projections. This allows the insulation to be reliably cut through, and the wire to be pressed into the insulation displacer, by the movement of the swiveling cover without the possibility of bending the insulation displacement contact.

Furthermore, connections can be rearranged practically when the swiveling cover and the key function respectively together with latching means, which can be released with release keys for the purpose of creating a new insulation displacement wire connection.

Furthermore, the contact mount can, of course, be adapted to create disconnectable through-connections between a multiplicity of neighboring incoming lines and a multiplicity of neighboring extending lines.

Furthermore, the present invention relates to the application of the modular contact mount according to the invention for connecting electrical wires, for example dropwires, for telecommunications purposes.

BRIEF DESCRIPTION OF THE DRAWINGS

Examples of embodiments of the invention are described in more detail below on the basis of the drawings. The following are shown.

DETAILED DESCRIPTION OF THE INVENTION

As is known, the illustrated modular contact mount for a solderless insulation displacement wiring connection of electrical wires comprises means for pressing the inserted wires into the insulation displacer of an insulation displacement contact when pressed onto the contact mount.

Figure 1:
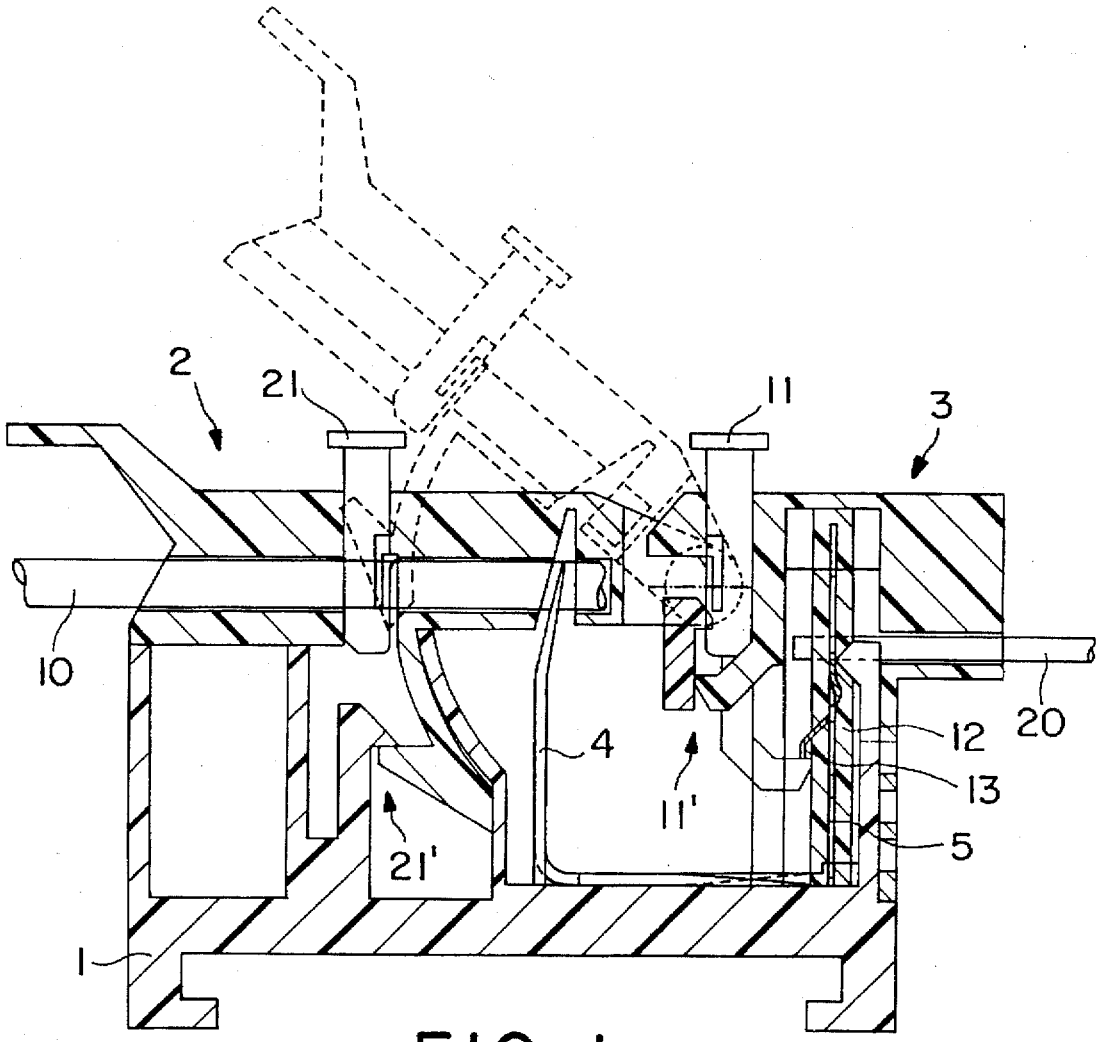
FIG. 1 is a cross-section of the modular contact mount for solderless insulation displacement wiring of electrical wires according to the invention.
Figure 2:
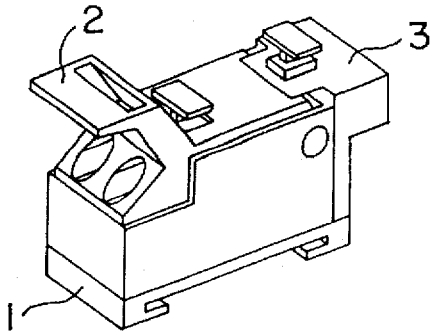
FIGS. 2 and 3 are differing perspective views of the contact mount according to the invention for two incoming and two outgoing wires, with common wiring means.
Figure 3:
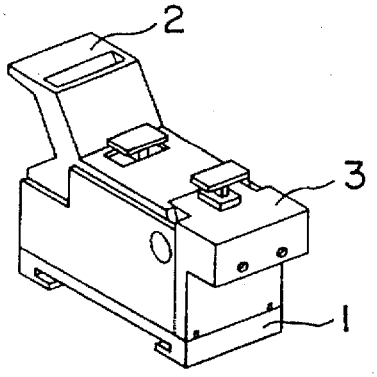

According to the invention, and referring generally to FIGS. 1 through 3, the modular contact mount 1 creates a disconnectable through-connection between incoming wire 10 and outgoing wire 20. Means 2 and 3 grip both the incoming wire 10 and the outgoing wire 20. These means 2, 3 additionally press the incoming wire 10 and outgoing wire 20, respectively, into the respective insulation displacer 4' and 5' (FIG. 6) of the respective insulation displacement contacts 4 and 5, when pressed downward.

Such a modular contact mount can be adapted for use with a relatively large number of incoming and outgoing wires with a corresponding number of wiring means, and furthermore, can be adapted to be slid or latched onto a cable channel or as a connection element or disconnection element or for use on printed circuit boards.

As shown in FIG. 1 in particular, the means for pressing the incoming wire 10 downward into the insulation displacer 4' of the respective insulation displacement contact 4 comprises a swiveling cover 2 attached to the contact mount 1 in a hinged connection. The means for pressing the extending wire 20 downward into the insulation displacer 5' of the respective insulation displacement contact 5 comprises a key 3.

Figure 4:
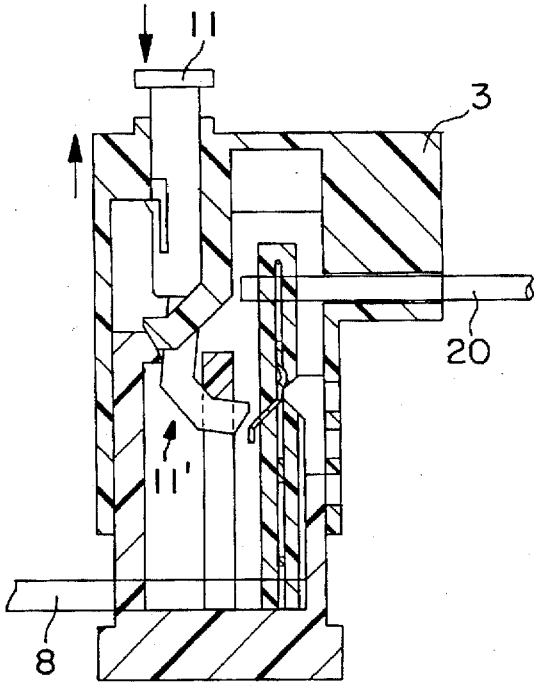
FIGS. 4 and 5 show the outgoing side of the contact mount shown in FIG. 1, for illustration of the wiring means when connected and when disconnected.
Figure 5:
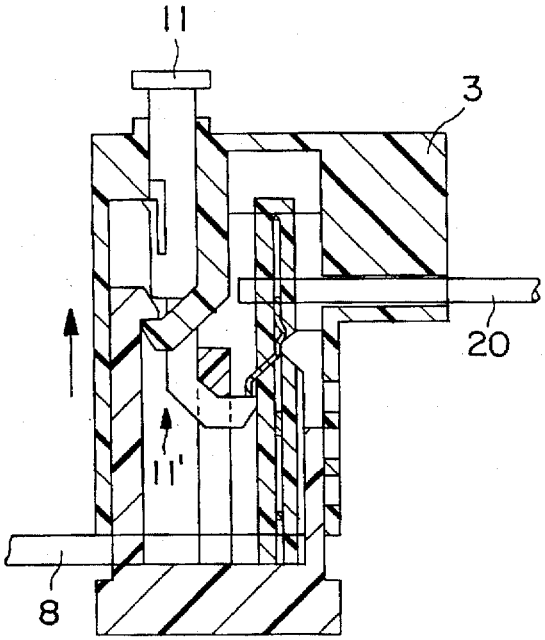

In operation, swiveling cover 2 and key 3 each function together with latching means 11' and 21' which can be released with release keys 11, 21, respectively, to allow rearrangement of the wiring at any time, as is shown in FIGS. 1 and 4. Furthermore, as shown in FIG. 5, the key 3 can be moved out of its depressed connected position (which position is shown in FIG. 1) and into an intermediate position at which the through-connection is disconnected, whereby the insulation displacement contact 5, which functions together with the key 3 for the extending wire, follows key 3 to a position between a connected position and a disconnected position. The insulation displacement contact 5 for the extending wire can be shifted within a slotted guide 12 formed on the contact mount 1 (FIG. 1) and can be actuated by the key 3 via a carrier 13 for this purpose.

Figure 6:
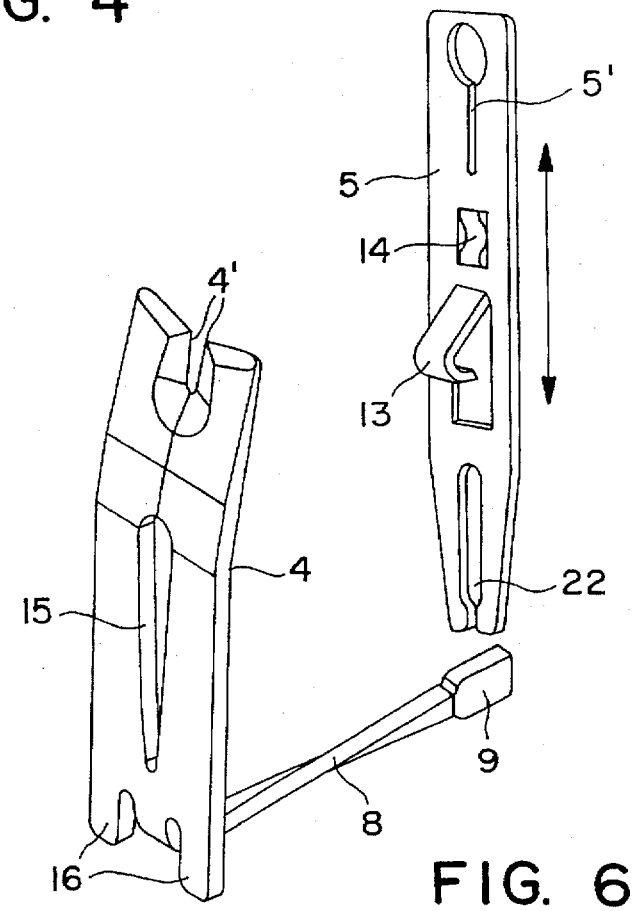
FIG. 6 is a large-scale diagram of the insulation displacement contacts of the contact mount, which are adapted to function together, as shown in FIG. 1.

The free end of the insulation displacement contact 5 for the extending wire 20 is in the shape of a forked contact 22, as shown in FIG. 6, for the purpose of creating a disconnectable through-connection. Furthermore, the free end of the insulation displacement contact 4 for the incoming wire on the contact mount 1 is provided with an L-shaped projection 8 with a contact head 9. Contact head 9 extends into the shifting path of the insulation displacement contact 5 for the extending wire 20, for contact with the forked contact 22. The insulation displacement contact 5 can be held in its disconnected position by means of a retaining projection 14.

For the purpose of fixing the thickest wire with hard insulation in an insulation displacement wiring connection at the insulation displacement contact 4, the area near the insulation displacer 4' of insulation displacement contact 4, especially for the incoming wire 10, is bent away from (i.e., counter to) the swiveling movement of the swiveling cover 2, as shown in FIG. 6. Moreover, this area is provided with knife-like angled projections so that the insulation is reliably cut through and the wire is pressed downward into the insulation displacer 4' by the swiveling movement of the swiveling cover 2 without the possibility of bending the insulation displacement contact 4. Furthermore, the contact base of the insulation displacement contact 4 is made elastic by a recess 15, which evenly distributes strains created during wiring, so that permanent deformation is avoided. Moreover, the lower supports 16 absorb vertical forces created during wiring.

Figure 7:
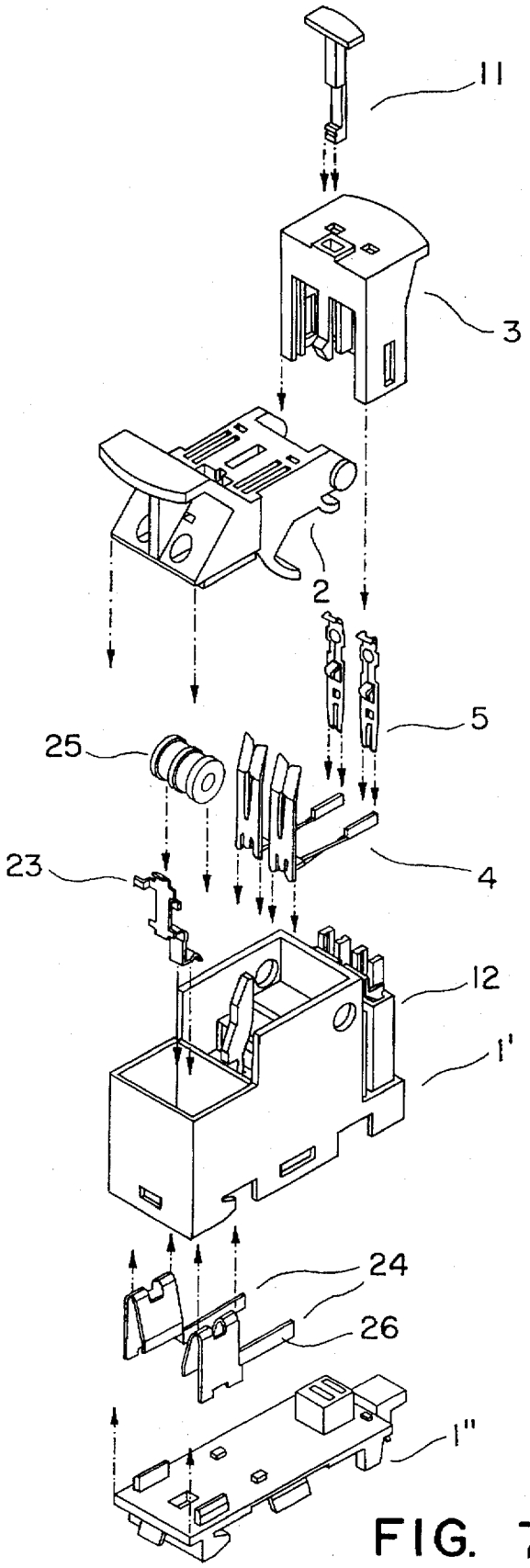
FIG. 7 is an exploded view of an alternative embodiment of the modular contact mount for a solderless insulation displacement wire connection of electrical wires according to the invention.

FIG. 7 shows an exploded view of an alternative embodiment of the modular contact mount for solderless insulation displacement wiring connections of electrical wires according to the invention. In addition to the floor 1" and the housing 1', the swiveling cover 2, the key 3, the insulation displacement contacts 4 and 5 and the release key 11 can be recognized. Furthermore, ground contacts 23 and contacts 24 for receiving overvoltage protection means 25 are clamped to the insulation displacement contacts 4 with connection means 26.

The descriptions above therefore result in a modular contact mount which permits disconnectable through-connections of incoming and extending wires, such as overhead wires or internal wires, by means of solderless insulation displacement wiring connections, without using the expensive and difficult-to-use plug strips. This can be done extremely easily and without tools. Such modular contact mounts according to the invention can also be used for connecting other types of electrical wires, such as dropwires.

The invention now being fully described, it will be apparent to one of ordinary skill in the art that any changes and modifications can be made thereto without departing from the spirit or scope of the invention as recited in the claims.

What is claimed is:

1. An assembly for forming a solderless insulation displacement wiring connection of electrical wires, comprising:

(a) a modular contact mount including a slotted guide formed thereon;

(b) first and second insulation displacement contacts located within said contact mount, each having a respective first and second insulation displacer region formed on an end thereof; said first and second insulation displacement contacts being associated, respectively, with an incoming wire and an outgoing wire inserted into the assembly; said second insulation displacement contact having a free end including a forked contact for electrically contacting said first insulation displacement contact;

(c) gripping means for gripping the incoming wire and the outgoing wire; said gripping means being movable to press a selected wire into the respective insulation displacer region when said gripping means is pressed downward toward said contact mount, to form a disconnectable through-connection of the incoming and outgoing wires; said gripping means including (1) a swiveling cover hingedly attached to said contact mount for pressing the incoming wire down into said first insulation displacer region; and (2) a key movably located within said contact mount for pressing the outgoing wire downward into said second insulation displacer region; said key being operatively connected with said second insulation displacement contact for actuating said second insulation displacement contact; and (d) releasing means for releasing said swiveling cover and said key so that an electrical connection formed between the selected wire and the respective insulation displacer region can be modified; said releasing means allowing said key to be shifted from a depressed connected position into an intermediate position in which the through-connection is disconnected; a shifting of the key causing the second insulation disconnected; a shifting of the key causing the the slotted guide between a connected position and a disconnected position.

2. The assembly defined in claim 1, further comprising latching means for latching said swiveling cover and said key in a desired position; and at least one release key operatively connected to said latching means for releasing said latching means.

3. The assembly defined in claim 1, wherein said contact mount forms a disconnectable through-connection between a plurality of neighboring incoming wires and a plurality of neighboring outgoing wires.

4. The assembly defined in claim 1, wherein said modular contact mount connects dropwires for telecommunications together.

5. An assembly for forming a solderless insulation displacement wiring connection of electrical wires, comprising:

(a) a modular contact mount;

(b) first and second insulation displacement contacts located within said contact mount, each having a respective first and second insulation displacer region formed on an end thereof; said first and second insulation displacement contacts being associated, respectively, with an incoming wire and an outgoing wire inserted into the assembly; said first insulation displacement contact being supported by said contact mount and being provided with an L-shaped downward projection having a contact head on a free end thereof; said contact head extending into a shifting path of said second insulation displacement contact; said second insulation displacement contact having a forked contact engageable with said contact head;

(c) gripping means for gripping the incoming wire and the outgoing wire; said gripping means being movable to press a selected wire into the respective insulation displacer region when said gripping means is pressed downward toward said contact mount, to form a disconnectable through-connection of the incoming and outgoing wires; said gripping means including (1) a swiveling cover hingedly attached to said contact mount for pressing the incoming wire down into said first insulation displacer region; and (2) a key movably located within said contact mount for pressing the outgoing wire downward into said second insulation displacer region; said key being operatively connected with said second insulation displacement contact; and (d) releasing means for releasing said swiveling cover and said key so that an electrical connection formed between the selected wire and the respective insulation displacer region can be modified; said releasing means allowing said key to be shifted from a depressed connected position into an intermediate position in which the through-connection is disconnected; a shifting of the key causing the second insulation displacement contact to be shifted between a connected position and a disconnected position.

6. The assembly defined in claim 5, wherein an area near the first insulation displacer region is bent counter to a swiveling movement of the swiveling cover and is provided with knife-like angled projections.

* * * * *